United States Patent [19]

Lewis

[11] Patent Number: 4,855,070

[45] Date of Patent: Aug. 8, 1989

[54] ENERGY TRANSMITTING FLUID

[75] Inventor: Walter E. F. Lewis, Stamford, Conn.

[73] Assignee: Union Carbide Corporation, Danbury, Conn.

[21] Appl. No.: 206,201

[22] Filed: Sep. 16, 1988

Related U.S. Application Data

[63] Continuation of Ser. No. 947,878, Dec. 30, 1986, abandoned.

[51] Int. Cl.[4] ..... C10M 173/02

[52] U.S. Cl. ..... 252/75; 252/47.3; 252/76; 252/77; 252/78.1; 252/79

[58] Field of Search ..... 252/75, 76, 77, 78.1, 252/79, 49.3

[56] References Cited

U.S. PATENT DOCUMENTS

| | | | |
|---|---|---|---|
| 2,558,030 | 6/1951 | Zisman et al. | 252/75 |
| 2,602,780 | 7/1952 | Zisman et al. | 252/73 |
| 2,768,141 | 10/1956 | Langer et al. | 252/73 |
| 2,947,699 | 8/1960 | Wasson et al. | 252/76 |
| 3,108,076 | 10/1963 | Luechauer et al. | 252/76 |
| 3,992,312 | 11/1976 | Genjida et al. | 252/77 |
| 4,312,768 | 1/1982 | Nassry et al. | 252/76 |
| 4,390,439 | 6/1983 | Schwartz et al. | 252/75 |
| 4,390,440 | 6/1983 | Schwartz et al. | 252/76 |
| 4,434,066 | 2/1984 | Lewis | 252/77 |
| 4,481,125 | 11/1984 | Holgado | 252/75 |
| 4,493,777 | 1/1985 | Snyder, Jr. et al. | 252/79 |
| 4,493,780 | 1/1985 | Schwartz et al. | 252/73 |

*Primary Examiner*—Paul Lieberman
*Assistant Examiner*—Christine A. Skane
*Attorney, Agent, or Firm*—Eugene C. Trautlein

[57] ABSTRACT

A water-glycol energy transmitting fluid having a viscosity of from about 10 to about 200 centistokes at 40° C. comprising:

(a) from about 30 to about 40 percent by weight, based upon the total weight of the fluid, of water,
(b) diethylene glycol,
(c) from about 0.8 to about 5.0 percent by weight, based upon the total weight of fluid, of an aliphatic carboxylic acid having 9 to 12 carbon atoms,
(d) a water-soluble polymeric viscosity control agent,
(e) A corrosion inhibiting amount of at lease one corrosion inhibitor, and
(f) a metal deactivator.

17 Claims, No Drawings

ENERGY TRANSMITTING FLUID

This application is a continuation of prior U.S. application Ser. No. 947,878 filed Dec. 30, 1986, now abandoned.

FIELD OF THE INVENTION

This invention relates to energy transmitting fluids and, more particularly, to water-glycol type energy transmitting fluids having enhanced lubricity and anti-wear properties under high pressure conditions.

BACKGROUND OF THE INVENTION

Water-based fluids have been used commercially for many years as a means of transmitting energy in hydraulic systems. Among such water-based fluids are the water-soluble glycol or glycol ether-containing compositions (hereinafter "water-glycol" type fluids) disclosed, for example, in U.S. Pat. Nos. 2,558,030 and 2,602,780 both to Zisman et al., and U.S. Pat. No. 2,768,141 to Langer et al.

Compared to petroleum-based fluids, water-glycol type fluids generally have low flammibility, and good temperature stability. Moreover, clean-up and disposal are usually more convenient when utilizing water-glycol type fluids as opposed to petroleum-based compositions. However, water-glycol type energy transmitting fluids, such as are disclosed by the above-cited patents, generally have relatively poor lubricating and anti-wear properties in high pressure applications.

Various lubricity and/or anti-wear additives have been suggested in attempts to improve the performance of water-glycol type energy transmitting fluids.

U.S. Pat. No. 2,947,699 to Wasson, et al. discloses the use of alkali metal soaps of an organic aliphatic acid as an anti-wear agent in water-glycol type hydraulic fluids.

U.S. Pat. No. 4,493,777 to Snyder, Jr., et al. discloses a water-based hydraulic fluid having incorporated therein as an antiwear or lubricity agent, the metal or amine salt of an organo sulfur, phosphorous, boron or carboxylic acid.

U.S. Pat. No. 3,992,312 to Genjida, et al. discloses a water-glycol base hydraulic fluid comprising from about 30–60 weight percent of water; from about 5–30 weight percent of a water-soluble polymer containing (1) a residue of a polyamide having active hydrogen atoms and (2) oxyalkylene groups bonded to the residue; and from about 15–60 weight percent of a glycol, said fluid being disclosed as having good lubricating and wear preventing qualities.

U.S. Pat. No. 4,434,066 to Lewis discloses a water-glycol type fluid composition having incorporated therein between about 0.1 to 10 percent by weight of an acidic lubricity agent (i.e., saturated and unsaturated carboxylic and polycarboxylic acids having at least 6 carbon atoms, aromatic carboxylic acids, alkali metal or organic amine salts of said carboxylic acids, polymerized fatty acids, oxycarboxylic acids and dicarboxylic acids), and between about 0.01 and about 10 percent by weight of an anti-wear agent (i.e., a combination of an hydroxyl-substituted aromatic acid component and a nitroaromatic compound component).

U.S. Pat. No. 4,390,439 to Schwartz et al. discloses the use of neodecanoic acid to improve to anti-wear and corrosion-inhibiting properties of hydraulic fluids having a water content of from about 60 to about 99 weight percent.

The disclosures of the prior art regarding the enhanced lubricity and anti-wear benefits of additive containing fluids notwithstanding, prior to this invention the lubricity and wear characteristics of water-glycol type fluids have limited the use of such fluids to systems operating at pressures of less than about 3,000 psi.

Accordingly, it is an object of this invention to provide a water-glycol type energy transmitting fluid having enhanced high pressure performance.

SUMMARY OF THE INVENTION

This invention relates to an energy transmitting fluid, suitable for use in systems operating at pressures up to at least about 5,000 psi, comprising:

(a) from about 30 to about 40, preferably from about 34 to about 37 percent by weight, based on the total weight of the fluid, of water;
(b) diethylene glycol;
(c) from about 0.8 to about 5.0 percent by weight, based on the total weight of the fluid, of an aliphatic carboxylic acid having 9 to 12 carbon atoms, inclusive;
(d) a water-soluble polymeric viscosity control agent;
(e) a corrosion inhibiting amount of at least one corrosion inhibitor; and
(f) a metal deactivator, wherein (b) and (d) are present in amounts sufficient to provide the fluid with a viscosity of from about 10 to about 200 centistokes at 40° C.

This invention further relates to a method of transmitting mechanical energy by fluid pressure in systems operating at pressures up to at least about 5,000 psi, wherein the fluids herein described are utilized as an energy transmitting medium.

It has been found that the particular combination of water, diethylene glycol and carboxylic acid herein disclosed is effective in enhancing the high pressure performance of water-glycol type energy transmittingg fluids, rendering such fluids suitable for use in systems operating at pressures up to at least about 5,000 psi, preferably up to at least about 7,000 psi and most preferably up to at least about 10,000 psi.

DESCRIPTION OF THE INVENTION

In accordance with the present invention there is provided a water-glycol composition having a viscosity of from about 10 to about 200 centistokes at 40° C. comprising water, diethylene glycol, an aliphatic carboxylic acid having 9 to 12 carbon atoms, a water-soluble polymeric viscosity control agent, at least one corrosium inhibitor, and a metal deactivator.

The aliphatic carboxylic acid component of the composition of this invention is selected from the group consisting of saturated and unsaturated, linear and branched carboxylic and polycarboxylic acids having 9 to 12 carbon atoms and mixtures thereof. Representative of the carboxylic acids suitable for use herein are nonanoic, decanoic, neodecanoic, undecanoic, and dodecanoic acids, and mixtures thereof. For purposes of this invention, the $C_9$ to $C_{12}$ carboxylic acid is generally present in the above described composition in an amount of from about 0.8 to about 5.0 percent by weight, preferably from about 1.0 to about 2.0 percent by weight, and, most preferably, from about 1 to about 1.6 percent by weight, all based upon the total weight of the composition. At concentrations of less than about 0.8 percent by weight, the $C_9$ to $C_{12}$ carboxylic acids are generally unable to provide the lubricity required for high pressure applications.

For purposes of this invention linear carboxylic acids, having ten to twelve carbon atoms, inclusive, constitute a preferred class of carboxylic acids.

The polymeric viscosity control agents of the composition of this invention include poly(alkylene oxide)-polymers, alkylene oxide adducts of alkyl phenols, polyalkyl methacrylates, urethane polymers, polyamide esters, and polyamide alkoxylates, with poly(alkylene oxide)polymers being a preferred class of polymers.

The poly(alkylene oxide)polymers suitable for use herein contain oxyethylene groups or a random or block distribution of both oxyethylene groups and higher oxyalkylene groups such as oxypropylene and oxybutylene groups and have average molecular weights of from about 400 to about 40,000, or even higher. The amount of oxyethylene groups in the molecule is such that the poly(alkylene oxide)polymers are soluble in water at 25° C. and the amount of oxypropylene or higher oxyalkylene groups is such that the poly(alkylene oxide) remains liquid at 25° C. up to an average molecular weight of 40,000 and higher. The oxypropylene/oxyethylene ratio may vary from zero to about unity. These poly(alkylene oxide)polymers may be made by processes well known in the art by reacting ethylene oxides or mixtures of ethylene oxide and propylene oxide or higher alkylene oxide with a compound having at least one active hydrogen atom up to as many as six such active hydrogen atoms including, for example, water, monohydroxylic alcohols such as ethanol and propanol, dihydroxylic alcohols such as ethylene glycol, trihydroxylic alcohols such as glycerine and trimethylpropane, tetrahydroxylic alcohols such as pentaerythritol, hexahydroxylic alcohols such as sorbitol, and mono- or poly-functional amines such as butylamine and ethylene diamine. The poly(alkylene oxide) products of such reaction will have linear or branched oxyethylene or oxyethylene-higher oxyalkylene chains and such chains will terminate with hydroxyl groups. Some or all of these hydroxyl groups may be etherified by reaction with a dialkyl sulfate such as diethyl sulfate.

Alkylene oxide adducts of alkyl phenols suitable for use herein include the adducts disclosed, for example, in U.S. Pat. No. 2,768,141 to Langer et al. and U.S. Pat. No. 3,379,644 to Katzenstein et al.

Polyalkyl methacrylates and polyurethanes such as may be employed herein are disclosed, for example, in U.S. Pat. No. 3,352,783 to McCord. These polyalkyl metharylates generally result from the polymerization of alkyl methacrylates in which the alkyl groups have an average of from about 3 to about 10 carbon atoms.

Included among the polyamide esters suitable for use herein are the polymers disclosed in U.S. Pat. No. 3,341,573 to Shibe. Suitable polyamide alkoxylates are disclosed, for example, in U.S. Pat. No. 3,992,312 to Genjida et al.

For purposes of this invention, random copolymers of ethylene oxide and 1,2-propylene oxide having a viscosity of up to about 100,000 centistokes at 100° C., preferably of from about 5,000 centistokes to about 50,000 centistokes at 100° C. and comprising from about 65 to about 85 weight percent of oxyethylene groups are preferred.

It will be apparent to the art-skilled that the relative quantities of viscosity control agent and diethylene glycol provided to the energy transmitting compositions of this invention are subject to variation depending upon the desired viscosity of the energy transmitting composition and the particular viscosity control agent employed therein. Preferably, the diethylene glycol and viscosity control agent are present in the compositions of this invention in amounts sufficient to provide such compositions with a viscosity of from about 35 to about 80 centistokes at 40° C. In general, composition viscosities within the previously described ranges of preference are achieved by utilizing a poly(alkylene oxide) viscosity control agent in an amount of from about 10 to about 20 percent by weight of the composition, and diethylene glycol in an amount of from about 40 to about 60 percent by weight of the composition.

The optimum viscosity of the fluid compositions of this invention is subject to variation and depends in part on the type of pump employed in a given operation. For example, vane pumps typically operate at pressures up to about 3,000 psi and employ as the fluid of choice a composition having a viscosity of from about 60 to about 80 centistokes at 40° C., whereas, the fluid of choice in axial piston pumps, which generally operate at pressures of from about 5,000 psi to about 6,000 psi typically has a viscosity of from about 35 to about 50 centistokes at 40° C.

Included among the corrosion inhibitors suitable for use in the compositions of this invention are alkyl amines such as, for example, propylamine, butylamine, hexylamine, n-octylamine, cyclohexylamine, dimethylaminopropylamine, and the like; alkanolamines such as, for example, ethanolamine, diethanolamine, triethanolamine, N,N-dimethylethanolamine, arylamines such as aminotoluene and the like; as well as other amine-type corrosion inhibitors such as for example, ethylene diamine, isopropylaminoethanol, tripropylamine, morpholine, pyridine, 1,4-bis(2-aminoethyl)pyperdine, imidazoline, 2-heptadecyl-1-(2-hydroxyethyl)-imidazoline, and the like; and mixtures thereof. In addition to the amine type corrosion inhibitors, other corrosion inhibitors suitable for use herein include alkali metal nitrites, nitrates and benzoates, alkoxylated fatty acids, and mixtures thereof.

The amount of corrosion inhibitor present in the composition of this invention is subject to variation and depends in part upon factors which include choice of inhibitor(s) and the severity of the application in which the fluid is employed. In general the total amount of inhibitor present in the composition of this invention ranges from about 0.4 to about 4.0 percent by weight, based upon the total weight of the composition. As used herein a "corrosion inhibiting amount" of inhibitor is at least that amount of one or more inhibitors which is effective in achieving the degree of corrosion protection required by a particular application.

The metal deactivatiors used herein function primarily as chelating agents for copper and copper alloys. Representative of the metal deactivators suitable for use in the compositions of this invention are tolyltriazole, benzotriazole, mercaptobenzothiazole, sodium mercaptobenzothiazole, disodium 2,5-mercaptothiadiazole, mercaptobenzoimidazole, and the like, and mixtures thereof. In general, the total amount of metal deactivator present in the composition of this invention is from about 0.01 to about 2.0 percent by weight, based upon the total weight of the composition.

In addition to the components previously described, the energy transmitting fluids of this invention may further comprise one or more additional components as are conventionally used in water-based fluids. When present, the total amount of all such additional components typically constitutes from about 0.001 to about 2% percent of the total weight of the fluid composition.

Exemplary of such additional components are foam inhibitors, such as silicones of the emulsion type, polyoxyalkylene type nonionic surfactants, and the like; alkaline compatible dyes; sequestering agents such as aminocarboxylic acids and derivatives thereof including ethylenediaminetetraacetic acid (EDTA), diethylenetriaminepentaacetic acid, the sodium or copper salts thereof, and oxycarboxylic acids and derivatives thereof such as tartaric acid and sodium glyconate; and such other additives as would not interact with the previously described components to adversely affect the lubricity of the resultant composition.

In preparing the water-based compositions of the invention, each of the components used may be added in any order of addition, or combinations of some of them may be prepared prior to incorporating same in the composition. In general, each of the components to be used should be in water-soluble form such as the alkali metal or ammonium salts thereof, or should be capable of being solubilized in situ. The compositions of this invention may be prepared from concentrates which in use are diluted to provide the water contents previously described.

In accordance with a preferred embodiment this invention, there is provided an energy transmitting fluid suitable for use in systems operating at pressures up to at least about 5,000 psi consisting essentially of:

(a) from about 34 to about 37 percent by weight, based upon the total weight of the fluid, of water, (b) from about 12 to about 16 percent by weight, based upon the total weight of the fluid, of a water-soluble polyalkylene oxide viscosity control agent, preferably a copolymer of ethylene oxide and propylene oxide having a viscosity of from about 40,000 centistokes to about 60,000 centistokes at 100° C. and comprising from about 70 to about 80 percent by weight, based upon the total weight of the copolymer, of ethylene oxide groups, (c) from about 1.0 to about 2.0 percent by weight, based upon the total weight of the fluid, of a linear aliphatic carboxylic acid having 9 to 12 carbon atoms, inclusive, preferably decanoic and/or dodecanoic acid, (d) from about 35 to about 40 percent by weight, based upon the total weight of the fluid, of diethylene glycol, (e) from about 1.4 to about 3.5 percent by weight, based upon the total weight of the fluid, of at least one amine-type corrosion inhibitor, preferably a combination of from about 0.6 to about 1.5 percent by weight, based on the total weight of the fluid, of morpholine and from about 0.8 to about 2.0 percent by weight, based on the total weight of the fluid, of isopropylaminoethanol, and, (f) from about 0.04 to about 0.1 percent by weight, based upon the total weight of the fluid, of a metal deactivator, preferably tolyltriazole.

EXAMPLES

The following Examples are illustrative of the present invention. It is not intended, however, that the scope of the invention be limited by these Examples. Unless otherwise indicated, all of the percentages referred to in the following Examples are by weight.

Examples 1 to 3 and Comparative Examples $C_1$ to $C_2$

The high pressure performance of the fluids formulated to the specifications of Table 1 was evaluated by means of the procedure described in ASTM D 2882-83 entitled "Standard Method for Indicating the Wear Characteristics of Petroleum and Non-Petroleum Hydraulic Fluids in a Constant Volume Vane Pump". The operational conditions employed in the test were as follows:

The procedure described in ASTM D2882-83 was repeated six times for each formulation. Following each run of a given test a fluid wear rate was obtained. Wear rates are given as the total weight loss of the pump's cam ring and vanes over the operational period of the test.

Wear rates provided in Table 1 represent an average value of six replicate test runs. A formulation was considered to pass the test if each of the six replicate runs provided wear rates of less than 1 gram/100 hours. If a given run provided a wear rate in excess of 1 gram/100 hours testing was discontinued and the formulation was considered to have failed the test.

| | |
|---|---|
| Pump | Vickers V-104C vane pump |
| Pump Speed | 1200 rpm |
| Pump Pressure | 1900 psig (134 kg/cm$^2$) |
| Fluid Temperature | 65° C. |
| Fluid Quantity | 2 gallons |
| Operational Period | 100 hours |

TABLE 1

| | Formulations (weight %)[1] | | | | |
|---|---|---|---|---|---|
| Ingredients | $C_1$ | $C_2$[2] | 1 | 2 | 3[3] |
| Deionized Water | 35.0 | 40.5 | 36.0 | 38.00 | 40.00 |
| Ethylene Glycol | 49.3 | 43.3 | — | — | — |
| Diethylene Glycol | — | — | 48.8 | 46.5 | 46.5 |
| UCON ®* 75H 380,000[4] | 12.5 | 13.6 | 12.0 | 12.3 | 12.6 |
| Morpholine | 0.8 | 0.8 | 0.8 | 0.8 | 0.8 |
| Isopropylaminoethanol | 1.0 | 1.2 | 1.0 | 1.0 | 1.0 |
| Decanoic Acid | 1.3 | 1.2 | 1.3 | 1.3 | 1.3 |
| Tolyltriazole | 0.1 | — | 0.1 | 0.1 | 0.1 |
| Sodium mercaptobenzothiazole | — | 0.1 | — | — | — |
| Wear Rate (mg/100 hrs) | — | — | 12 | 12 | 20 |
| Test Results | Fail | Fail | Pass | Pass | Fail |

1. In addition to the ingredients described above, each of the Formulations provided in Table 1 contained less than 0.01 weight percent of benzoic acid.

2. Test results for Formulations $C_2$ were based on a single pump test run.

3. Five of the 6 runs for Formulation 3 provided wear rates of less than 1 gram/100 hours, the sixth run provided a wear rate in excess of 1 gram/100 hours.

4. A linear polymer of ethylene oxide and propylene oxide commercially available from Union Carbide Corporation containing 75 weight percent oxyethylene, 25 weight percent oxypropylene, and characterized as having an S.U.S. viscosity of 380,000 at 100° F. (37.8° C.).

Example 4

The performance of a fluid prepared according to the specifications of Formulation 2 of Table 1 at operational pressures of 5,000 psi was evaluated by means of the following test procedure, said procedure being divided into a 2-hour start-up period, a 1 hour break-in period and 222-hour test period.

Sixteen gallons of test fluid was charged to a Sundstrand Model 22-2132 variable displacement pump equipped with welded pistons. Operational condition employed in the test were as follows:

| | |
|---|---|
| Input Speed | 3100 ± 100 l.p.m. |
| Load Pressure | 5000 psi |
| Change Pressure | 200 ± 20 psi |
| Case Pressure | 40 psi max. |
| Stroke | ½ of Full |
| Reservoir Temperature | 120 ± 10° F. |
| Loop Temperature | 170 ± 10° F. |
| Maximum Inlet Vacuum | 10 inches Hg (5 psi) |

At various times during the course of the test flow data readings were taken. Pursuant to this test, a degradation in flow rate is indicative of system wear (i.e. as the system wears the clearance between movable system parts increases and the flow rate of the fluid is decreased). Flow data for this test is reported in Table 2. An examination of the flow data in flow indicates that no significant degradation in flow occurred over the operational period of the test.

At the expiration of the 222-hour test period the system was cooled to a loop temperature of 100° F. and shut down. After a 24-hour shut-down period the pump was disassembled and examined for wear. Inspection of the test parts indicated that no unusual pump wear or distress occurred.

TABLE 2

| Reading | Flow (gal./min.) |
|---|---|
| After break-in | 24.8 |
| After 1 test hour | 24.9 |
| After 25 test hours | 24.9 |
| After 27 test hours | 24.9 |
| After 75 test hours | 24.9 |
| After 125 test hours | 24.9 |
| After 175 test hours | 24.8 |
| After 222 test hours | 24.7 |

What is claimed is:

1. An energy transmitting fluid which is substantially free of ethylene glycol consisting essentially of
   (a) from about 30 to about 40 percent by weight, based on the total weight of the fluid, of water;
   (b) from about 35 to about 50 percent by weight, based on the total weight of the fluid, of diethylene glycol;
   (c) from about 0.8 to about 5.0 percent by weight, based on the total weight of the fluid, of an aliphatic carboxylic acid having 9 to 12 carbon atoms inclusive;
   (d) a water-soluble polymeric viscosity control agent;
   (e) a corrosion inhibiting amount of at least one corrosion inhibitor; and
   (f) a metal deactivator, wherein (b) and (d) are present in amounts sufficient to provide the fluid with a viscosity of from about 10 to about 200 centistokes at 40° C.

2. A fluid as in claim 1 wherein the polymeric viscosity control agent is selected from the group consisting of poly(alkylene oxide)polymers, alkylene oxide adducts of alkyl phenols, polyalkyl methacrylates, urethane polymers, polyamide esters, and polyamide alkoxylates.

3. A fluid as in claim 2 wherein the corrosion inhibitor comprises at least one amine type corrosion inhibitor.

4. A fluid as in claim 3 wherein the metal deactivator is selected from the group consisting of tolyltriazole, benzotriazole, mercaptobenzothiazole, sodium mercaptobenzothiazole, disodium 2,5-mercaptothiadiazole, mercaptobenzoimidazole and mixtures thereof.

5. A fluid as in claim 1 and 4 wherein the water-soluble polymeric viscosity control agent is a poly(alkylene oxide)polymer.

6. A fluid as in claim 5 wherein the poly(alkylene oxide)polymer is a random copolymer of ethylene oxide and 1,2-propylene oxide having a viscosity of up to about 100,000 centistokes at 100° C.

7. A fluid as in claim 1 wherein the carboxylic acid is selected from the group consisting of nonanoic, decanoic, neodecanoic, undecanoic, and dodecanoic acid, and mixtures thereof.

8. A fluid as in claim 1 wherein component (e) is present therein in an amount of from about 0.4 to about 4.0 percent by weight, based on the total weight of the fluid.

9. A fluid as in claim 1 containing a combination of morpholine and isopropylamino ethanol as an amine-type corrosion inhibitor.

10. A fluid as in claim 9 wherein the metal deactivator is present therein in an of from about 0.01 to about 2.0 percent by weight, based on the total weight of the fluid.

11. An energy transmitting fluid which is substantially free of ethylene glycol consisting essentially of
   (a) from about 34 to about 37 percent by weight, based on the total weight of the fluid, of water,
   (b) from about 12 to about 16 percent by weight, based on the total weight of the fluid, of a water-soluble poly(alkylene oxide) viscosity control agent,
   (c) from about 1.0 to about 2.0 percent by weight, based on the total weight of the fluid, of an aliphatic carboxylic acid having 9 to 12 carbon atoms, inclusive,
   (d) from about 35 to about 50 percent by weight, based on the total weight of the fluid, of diethylene glycol,
   (e) from about 1.4 to about 3.5 percent by weight, based on the total weight of the fluid, of at least one amine-type corrosion inhibitor, and
   (f) from about 0.04 to about 0.1 percent by weight, based on the total weight of the fluid, of a metal deactivator.

12. A fluid as in claim 11 wherein the poly(alkylene oxide) viscosity control agent has a viscosity of from about 40,000 centistokes to about 60,000 centistokes at 100° C. and comprises from about 70 to about 80 percent by weight of ethylene oxide groups.

13. A fluid as in claim 10 containing a combination of morpholine and isopropylamino ethanol as an amine-type corrosion inhibitor.

14. A fluid as in claim 13 wherein the metal deactivator is tolyltriazole.

15. A fluid as in claim 14 wherein the aliphatic carboxylic acid is a linear carboxylic acid having ten to twelve carbon atoms, inclusive.

16. A fluid as in claim 15 wherein the aliphatic carboxylic acid is decanoic and/or dodecanoic acid.

17. A method of transmitting mechanical energy by fluid pressure in systems operating at pressures up to at least about 5,000 psi which comprises utilizing as an energy transmitting medium a fluid as described in claims 1, 4, 11 and 14.

* * * * *